US007193195B2

(12) United States Patent
Lundstrom et al.

(10) Patent No.: US 7,193,195 B2
(45) Date of Patent: Mar. 20, 2007

(54) WALL MOUNTED MICROWAVE OVEN HAVING A TOP VENT WITH FILTER SYSTEM

(75) Inventors: Hakan Lundstrom, Rejmyre (SE); Per Törngren, Norrköping (SE); Hans Lindgren, Norrköping (SE); Alan D. Bengtson, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/882,965

(22) Filed: Jul. 1, 2004

(65) Prior Publication Data

US 2006/0011622 A1 Jan. 19, 2006

(51) Int. Cl.
*H05B 6/80* (2006.01)
*F24C 15/20* (2006.01)
*H05B 6/78* (2006.01)

(52) U.S. Cl. ..... 219/757; 219/756; 219/754; 219/681; 126/21 A; 126/299 R

(58) Field of Classification Search ..... 219/756–757, 219/681, 400, 754; 126/21 A, 299 R, 21 R, 126/299 D
See application file for complete search history.

(56) References Cited

U.S. PATENT DOCUMENTS 4,143,646 A * 3/1979 Sampsel ..... 126/299 D
4,235,220 A * 11/1980 Hepner ..... 126/299 D
4,327,274 A 4/1982 White et al. ..... 219/10.55
5,886,330 A * 3/1999 Kang et al. ..... 219/757
6,242,725 B1 * 6/2001 Murata et al. ..... 219/757
6,621,057 B2 9/2003 Kim ..... 219/757
2003/0218011 A1 11/2003 Jeong ..... 219/757
2004/0000547 A1 1/2004 Kim ..... 219/757

FOREIGN PATENT DOCUMENTS

JP 1-184332 * 7/1989 ..... 219/756
JP 2-78184 * 3/1990 ..... 219/757

* cited by examiner

*Primary Examiner*—Philip H. Leung
(74) *Attorney, Agent, or Firm*—Robert O. Rice; Stephen Krefman; John F. Colligan

(57) ABSTRACT

A filter system for a wall mounted type microwave oven, which has an external enclosure surrounding an oven cavity. The external enclosure includes a bottom closure wall having a suction opening. The external enclosure also includes a top vent opening. An air exhaust path is formed between the external enclosure and the oven cavity wherein air drawn into the suction opening passes through the air exhaust path and is exhausted through the top vent opening. A first filter is provided on the suction side of the air exhaust path and a second filter may be provided on the exhaust side of the air exhaust path. In particular, the first filter may be provided adjacent the suction opening and a second filter may be provided adjacent the top vent opening, such that the first filter is provided at the inlet of the air exhaust path and the second filter is provided at the outlet of the air exhaust path.

16 Claims, 4 Drawing Sheets

WALL MOUNTED MICROWAVE OVEN HAVING A TOP VENT WITH FILTER SYSTEM

DESCRIPTION

The present invention relates to a microwave oven, and more particularly to an exhaust ventilation system for a microwave having an upwardly direct top vent provided with a filter.

BACKGROUND OF THE INVENTION

Conventional microwave ovens are generally classified into several different types including: tabletop microwave ovens designed to be seated on a table and/or countertop; and a ventilation hood-combined microwave oven designed to be mounted above a oven range—sometimes referred to as Over-The-Range (OTR) microwaves. An OTR microwave includes a ventilation hood type system for exhausting hot air, steam, smoke, etc. generated from the oven range. The ventilation system for a typical OTR microwave normally includes a suction opening, which is frequently provided with a grease/smoke filter, located along the bottom surface of the OTR microwave. Exhaust air flow is drawn into the suction opening and is passed around the microwave oven cavity and is directed either back into the kitchen environment through an exhaust outlet opening or is directed to an external exhaust.

U.S. Pat. No. 4,327,274 discloses an OTR microwave having a bottom vent openings provided with air intake filters wherein a blower draws exhaust air in through the vent openings and directs the exhaust air through a passage between the back wall of the microwave cavity and a rear cabinet wall. The exhaust air then exits the microwave assembly through either a top or rear outlet opening, depending on the installation configuration.

U.S. Patent Application 2003/0218011 A1 discloses a wall mounted microwave oven having an exhaust fan assembly which is mounted above and behind the cooking chamber. By changing the orientation of the fan case, the exhaust air may be directed upwardly, rearwardly or forwardly. In the forward direction, the exhaust gas is discharged forwardly into the room and may pass through a filter unit (not shown).

U.S. Pat. No. 6,621,057 discloses a OTR microwave having an exhaust fan located above the cooking chamber and to the rear of the cooking chamber. The exhaust fan system, including a motor and fans, exhausts air fowardly through a front mounted exhaust filter.

SUMMARY OF THE INVENTION

The present invention is directed to a unique filter system for a wall mounted type microwave oven. The microwave oven has an external enclosure surrounding an oven cavity. The external enclosure includes a bottom closure wall having a suction opening. The external enclosure also includes a top vent opening. An air exhaust path is formed between the external enclosure and the oven cavity wherein air drawn into the suction opening passes through the air exhaust path and is exhausted through the top vent opening. A first filter is provided on the suction side of the air exhaust path and a second filter may be provided on the exhaust side of the air exhaust path. In particular, the first filter may be provided adjacent the suction opening and a second filter may be provided adjacent the top vent opening, such that the first filter is provided at the inlet of the air exhaust path and the second filter is provided at the outlet of the air exhaust path.

The top vent opening may be provided along a horizontal top, front surface of the microwave oven. The second filter may also comprise at least one filter cover including frame supporting a filter mesh interior. The at least one filter cover may be removably fitted within a depressed region provided about the top vent area such that the filter cover is positioned below a top surface of the enclosure. A plurality of louvers may be provided across the top vent opening below the filter cover for supporting the filter cover and directing air flow.

BRIEF DESCRIPTION OF THE DRAWINGS

The present invention will be more apparent from the accompanying drawings, which are provided by way of non-limiting example and in which.

DETAILED DESCRIPTION OF THE PREFERRED EMBODIMENTS

Figure 1:
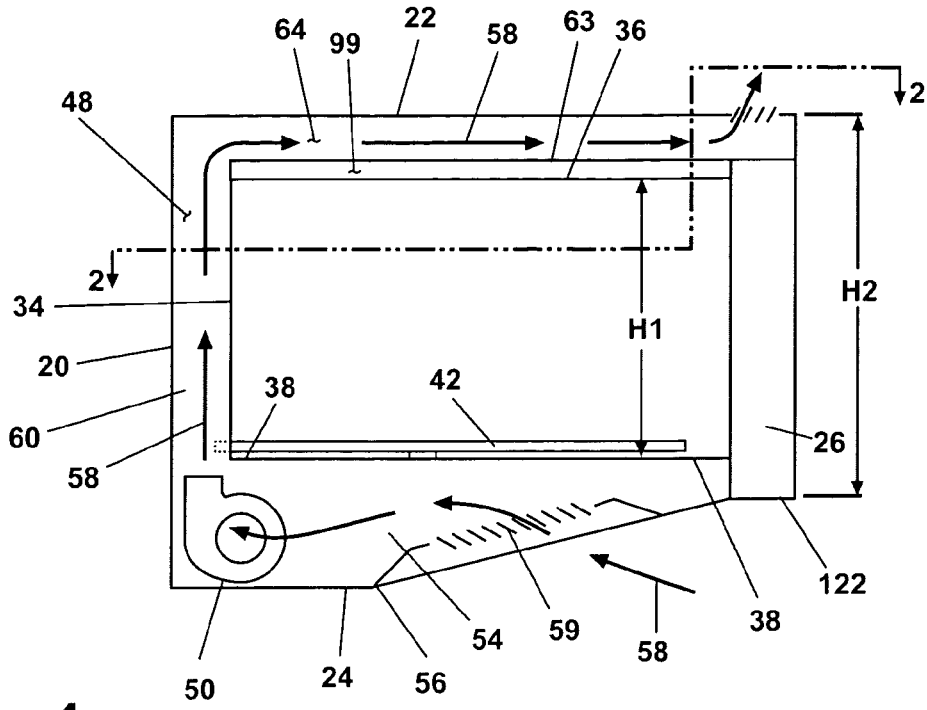
FIG. 1 is a side cross-sectional view of a microwave oven embodying the principles of the present invention.

Referring to the drawings, there is shown a ventilation hood-combined microwave oven 10 designed to be mounted to a wall above an oven range, sometimes referred to as an Over-The-Range (OTR) microwave or wall mounted type microwave, in accordance with the present invention.

Figure 2:
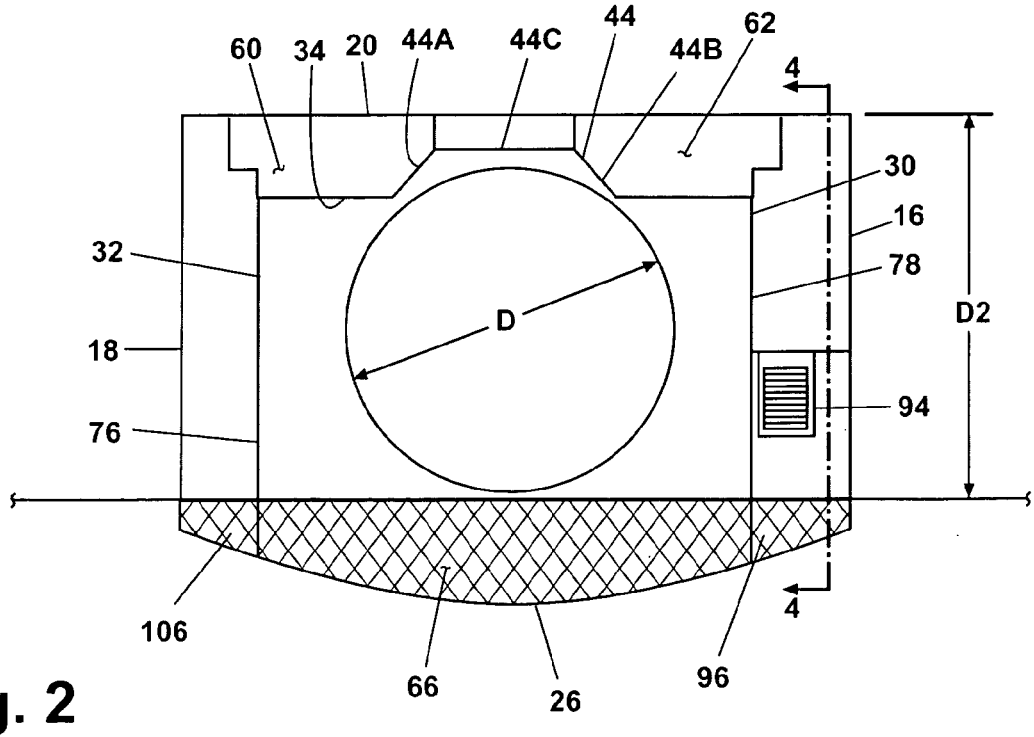
FIG. 2 is a top cross-sectional view taken along line II–II of FIG. 1.

Looking at FIGS. 1 and 2, it can be seen that the microwave oven 10 includes an oven cavity 12 which is provided within an exterior enclosure or outer case 14. The enclosure 14 includes side walls 16, 18, rear wall 20, a top wall 22 and a bottom closure wall 24. The front face or surface of the enclosure 14 is formed by a pivotable door 26 which may have a curved or bowed out shape.

The oven cavity 12 includes side walls 30 and 32, rear wall 34, a top wall 36 and a bottom wall 38. The cavity 12 is provided with a front access opening closable through operation of the pivotable door 26. Preferably, the height of the oven cavity (H) is maximized within a predetermined or predefined overall height of the enclosure (H2). The door 26 forms a front surface of the microwave and may extend along the full height (H2) of the enclosure. Rotatably supported within the oven cavity along the bottom wall 38 is a turn table plate 42.

The oven cavity 12 is designed to maximize the cooking volume within a fixed or predetermined total overall size of the microwave oven 10. It is desirable to have the diameter (D) of the plate a maximum size while at the same time minimizing the overall depth (D2). In order to accomplish this objective, the rear wall 34 of the oven cavity 12 has a rearwardly stepped portion 44 which includes two angled wall sections 44*a* and 44*b* and a center section 44*c*. This rearwardly stepped portion 44 extends toward and approaches the rear wall 20. The plate 42 is rotatably supported so that it partially extends into the rearwardly stepped portion 44.

An exhaust ventilation system is provided as part of the microwave oven 10. The exhaust ventilation system includes an air exhaust path, generally referred to at 48, which includes a bottom plenum 54, rear air channels 60 and 62, and an upper air plenum 64, as described hereinbelow. A pair of blowers 50 and 52 are located along the rear portion of the air plenum or space 54 which is formed between the bottom closure wall 24 of the enclosure 14 and the bottom wall 38 of the microwave oven cavity 12. The bottom closure wall 24 extends horizontally forward from its connection with the rear wall 20 to a crease or bend line 56 to provide an enlarged space along a rear portion thereof for locating the blowers 50 and 52. The blowers 50 and 52 include blower wheels 50*a* and 50*b* that have their longitudinal axis extending parallel to the plane occupied by the rear wall 34 and bottom wall 38 of the oven cavity 12. The blower wheels 50*a* and 52*a*, in turn, are carried within an air channeling housings 50*b* and 52*b*. While two blowers 50 and 52 are shown, it can be appreciated that only a single blower could also be used, or a pair of blower wheels driven by a single motor.

The blowers 50 and 52 operate to draw air into the blower wheels 50*a* and 52*a* in one direction and to direct the same air away from the wheels in a direction approximately 90 degrees displaced from the direction of flow of the entering air. By positioning the relatively large diameter blower wheels 50*a* and 52*a* in the enlarged rear portion of the plenum 54, the bottom closure wall 24 is permitted to slope upwardly toward the front. In this way, greater visibility of the space underneath the microwave oven 10 is provided. Moreover, by locating the blowers 50 and 52 in the preferred lower rear corner position as shown, an intake air stream 58 is created which takes a right angle turn in the air exhaust path through the blower wheels 50*a* and 52*a*. Changing the direction of an air stream flow results in a air flow resistance or efficiency loss. By locating the blower wheels 50*a* and 52*a* at the 90 degree bend in the path of the air stream 58, the efficiency of the exhaust ventilation system is increased.

Air is drawn or sucked into the exhaust ventilation system by the blowers 50 and 52 through a first filter 57 which is located in a suction opening 59 provided in the bottom closure wall 24. The filter 57 may be of metal mesh or baffle type.

After the air stream 58 passes through the blowers 50 and 52, the air stream is divided between two upwardly directed rear air channels 60 and 62 defined between the rear wall 20 of the enclosure 14 and the rear wall 34 of the oven cavity 12. The two rear air channels 60 and 62 are separated by the rearwardly stepped portion 44 which approaches the rear wall 20. The distance between the rear center section 44*c* and the rear wall 20 may be sufficient to allow for the provision of insulation along the surface of the rear wall 20. Or alternatively, the center section 44*c* may approach the rear wall 20 to the point of contact. Further, the air exhaust path may utilize only one of the rear air channels.

Figure 3A:
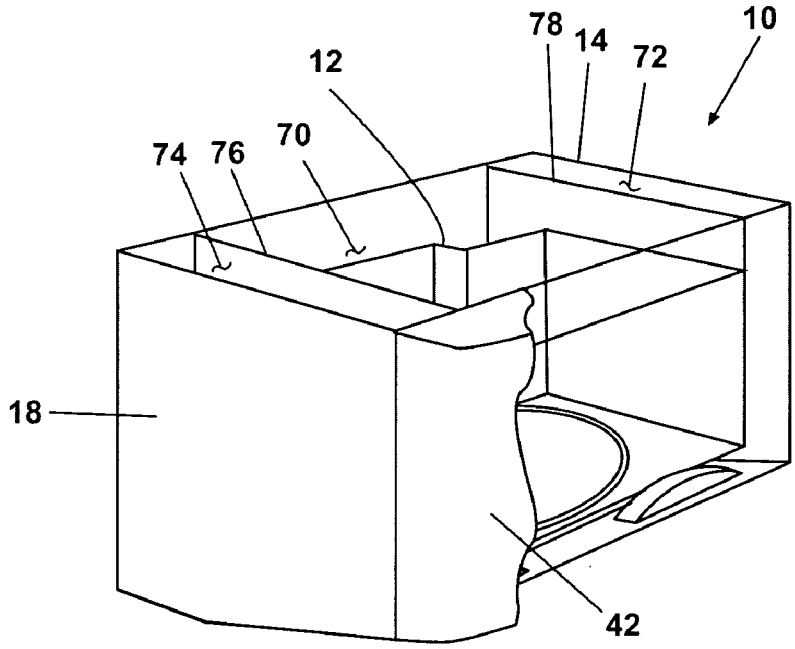
FIG. 3A is a perspective view of the microwave oven of FIG. 1, with portions of the door cut away to reveal internal structures.
Figure 3B:
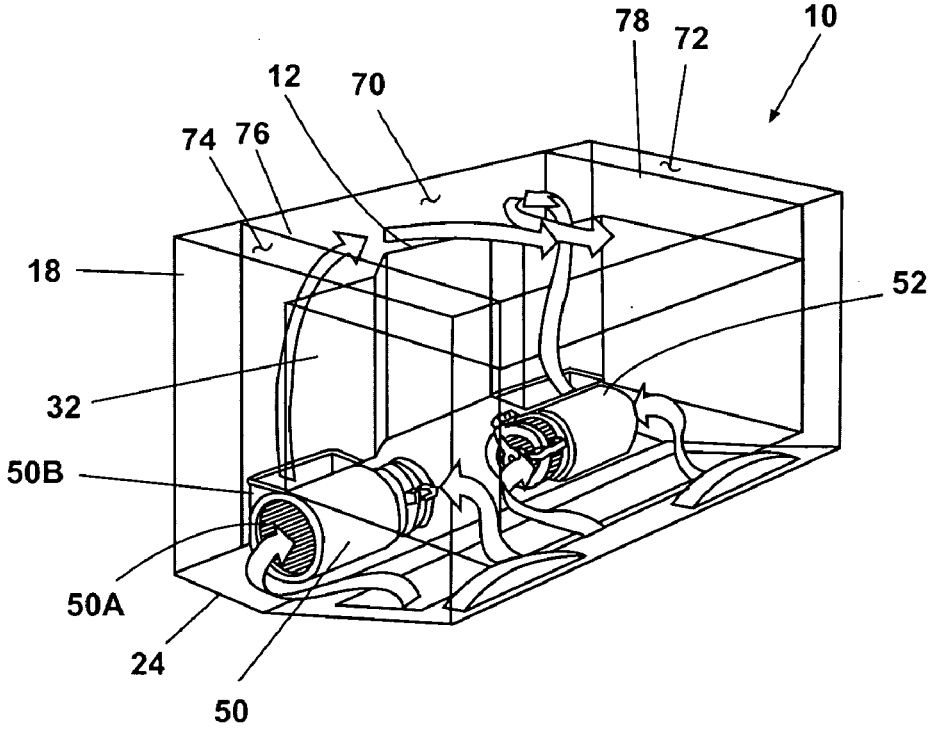
FIG. 3B is a perspective view of the microwave oven of FIG. 1, with the door removed and most wall sections being shown only in outline to allow for illustration of the air flow within the air exhaust path.

As seen in FIG. 1 and FIGS. 3A and 3B, once the air streams 58 reaches the top of the air channels 60 and 62, the air streams are again joined into a single air stream which is then directed around a 90 degree bend in the path of the air stream and flows toward the front face of the enclosure 14. The air stream moves forwardly along the wall 63 of the oven cavity 12 through a upper air plenum or space 64 toward a top exhaust opening 66. After reaching the top exhaust opening 66, the air stream is vented upwardly into the ambient environment. There may also be provisions to direct the air stream to an external vent (not shown) such that the air stream is directed upwardly or rearwardly from the back rear corner.

The enclosure 14 of the microwave 10 is effectively divided into three basic compartments, as best seen in FIG. 3. A center compartment 70 is provided along with a first side compartment 72 and a second side compartment 74. The oven cavity 12 and exhaust ventilation system discussed above are located within the center compartment 70. Divider walls 76 and 78 extend upward to the top wall 22 to completely seal the center compartment 70 from the side compartments 72 and 74. The divider walls 76 and 78 may be extensions of the side walls 30 and 32 of the oven cavity 12. In this way, air streams passing through the exhaust ventilation system do not enter into the side compartments.

Figure 4:
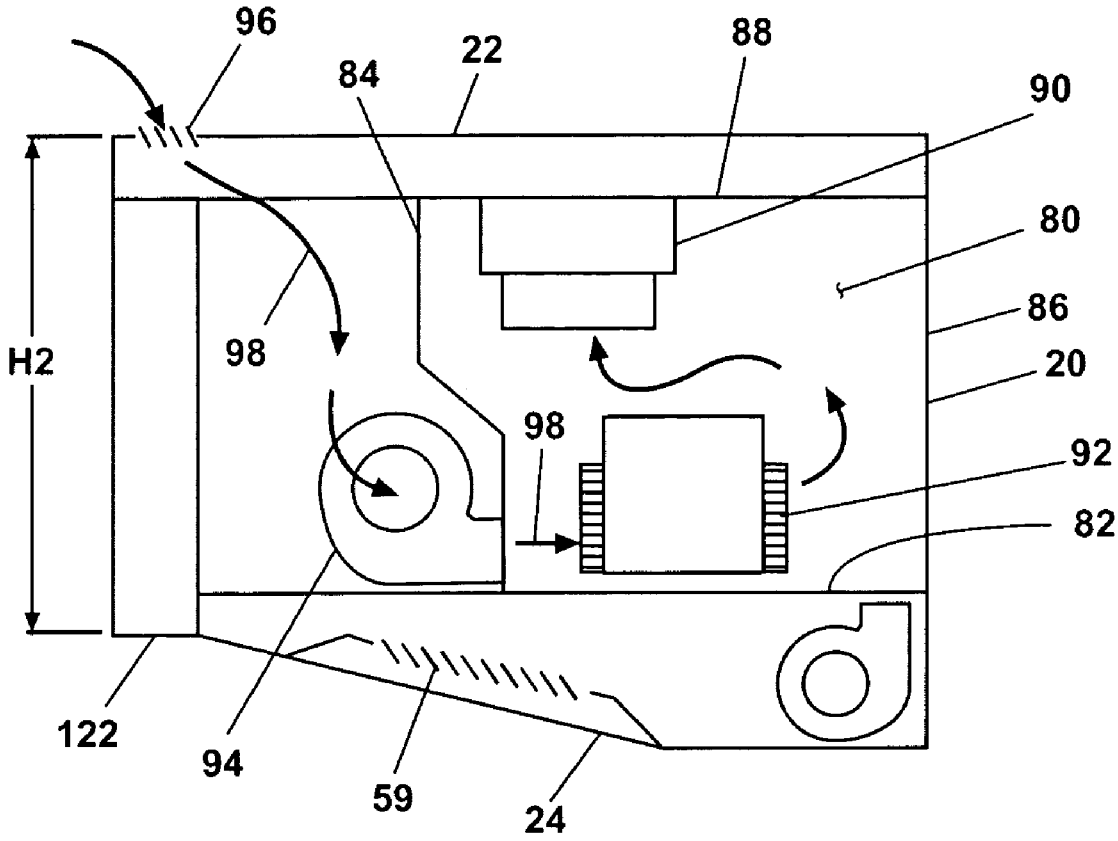
FIG. 4 is a side cross-sectional view of the microwave oven, taken along line IV—IV of FIG. 2.

The first side compartment 72 is configured to contain electrical equipment chamber 80 as shown in FIG. 4. The electrical equipment chamber 80 is defined by a bottom wall 82, a front wall 84 a rear wall 86 and a top wall 88. The side walls 16 and 30 may provide further enclosure walls to complete the electrical equipment chamber 80. Electrical equipment for generating microwave in order to heat food items within the oven cavity 12 are installed in the electrical equipment chamber 80. For example, a magnetron 90 and a high voltage transformer 92 may be provided within the electrical equipment chamber 80 along with other electrical items.

Mounted to the outside of the electrical equipment chamber 80 is a cooling fan or blower 94. The cooling blower 94 is operated to draw air into the first side compartment through a top, inlet vent opening area 96 and direct this cooling air stream 98 into the electrical equipment chamber 80. The cooling air stream 98 may then pass over and around the electrical components provided within the electrical equipment chamber 80 and then pass through the magnetron 90 into the oven cavity 12 or through an air channel 99 above the oven cavity 12.

It can be understood therefore, that when the exhaust blowers 50 and 52 operate, contaminated air flows through the exhaust ventilation system and is vented out into the ambient air through the center vent area 66. Since there is complete isolation of the first side compartment 72 and the electrical equipment chamber 80 from the exhaust ventilation system, the contaminated air stream 58 passing through the exhaust ventilation system does not flow through the electric equipment installation chamber 80. Therefore, the electric equipment such as the magnetron 90 and the high-voltage transformer 92, are not exposed to the contaminated air sucked through the exhaust ventilation system.

Figure 5:
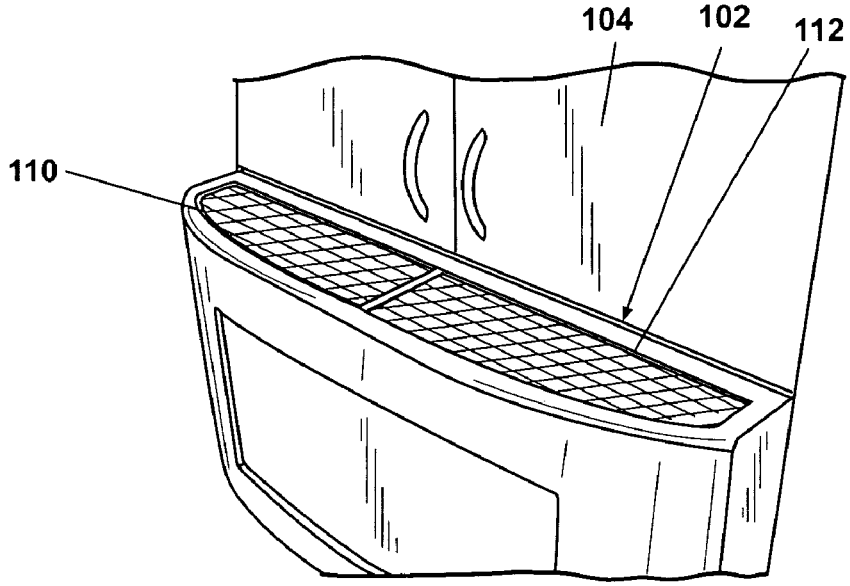
FIG. 5 is a top, front, right perspective view of the microwave oven of the present invention, showing in particular the top vent opening.
Figure 6:
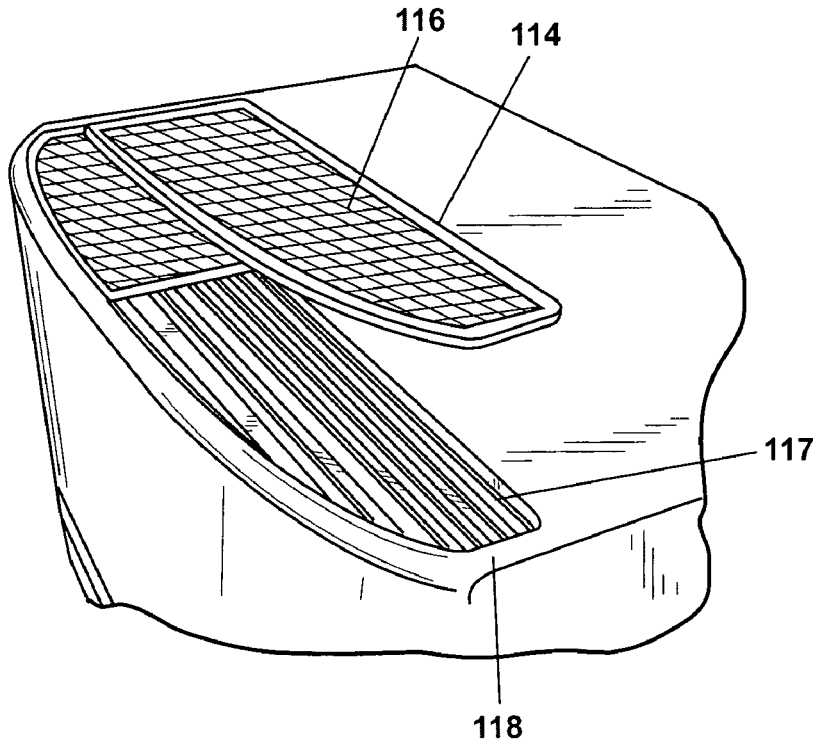
FIG. 6 is a top, front, right perspective view of the microwave oven of the present invention, showing in particular the top vent opening with one of the filter covers exploded from the microwave oven.

Turning now to FIGS. 5 and 6 in combination with FIGS. 1 and 2, the top vent opening 102 can be described. The top vent area 102 is the horizontal surface provided along the top, front of the microwave oven which extends outwardly beyond the cabinet structure 104 in which the microwave is commonly mounted. The top vent area 102 includes a center portion forming the top exhaust opening 66, and side portions that that form the top inlet vent opening 96 and an additional top outlet vent opening 106 (FIG. 3), located opposite the inlet opening 96. Air passing through the air channel 99 may exit the microwave through the outlet vent opening 106. As discussed above, after the air stream 58 passes through the exhaust ventilation system and vents upwardly into the ambient environment through the top exhaust opening 66. The side vent opening area 96 is an air inlet for the electrical equipment cooling system. As noted above, the other side vent opening area 106 may be used as an exhaust for the cooling air stream 98 but may also supply air to a forced air heating system (not shown) which may be mounted in the second side compartment 74.

It can be understood that it is desirable to minimize the overall height of the enclosure (H2) while at the same time providing a desired or required internal height within the oven cavity (H1). In particular, it is desirable to accommodate the desired cavity height (H1) without having the bottom closure wall 24 and a lower front edge 122 of the bottom closure wall too close to the cooktop which may be provided below the microwave oven 10. By providing a sufficient space between the lower front edge 122 and the cooktop, visibility of the cooktop is enhanced and the bottom closure wall 24 does not become too warm. The configuration of the present invention is designed to provide the desired visibility and space between the lower front edge 122 and the cook-top. By locating the top vent area 102 along the top surface provided of the microwave oven and by providing a bottom closure wall 24 which extends upwardly from the bend line 56 it is possible to minimized the overall height H2 and provide the benefits discussed above.

Provided along the top vent area 102 are a pair of filters 110 and 112 sometimes referred to as filter covers. These filter covers 110 and 112 are preferably constructed of a plastic frame 114 which supports a filter mesh interior 116. The filter covers 110 and 112 are removably fitted within a depressed region 117 provided about the top vent area 102 such that the filter covers are positioned below a top surface 118 of the microwave oven when they are properly installed. The top surface 118 may be formed as part of the top wall 22. The filter covers 110 and 112 are readily removed for cleaning. It can be appreciated that the filter covers are 110 and 112 may be formed as a single filter or as more than two filters. Additionally, various systems for retaining or snap fitting the filter covers into position may be employed to ensure that the filter covers are securely positioned.

The filter covers are designed to provide a final filter for exhausted air passing through the exhaust ventilation system and also to prevent foreign objects from passing into the upper air plenum 64 and the first and second side compartments 72 and 74. The intention behind the vent filter covers is odor reduction. This is normally achieved by "charcoal filters" (activated carbon). These can be either disposable or washable. Beneath the vent filter covers 110 and 112 are louvers 120 which direct the air flow outwardly and also support the vent filter covers 110 and 112.

Accordingly, it can be understood that the present invention is generally directed to a microwave having an air exhaust system wherein a filter is provide on the inlet side and a second filter is provided on the outlet side. Moreover, different types of filters may be used and the exhaust air flow path may be varied depending on the particular microwave construction.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A wall mounted type microwave oven comprising:

an external enclosure having a bottom closure wall which includes a suction opening, a top closure wall having a front edge, a top vent opening provided in the top closure wall adjacent the front edge, and an outer back wall;

an oven cavity supported within the external enclosure comprising an inner back wall having a rearward stepped portion extending toward and approaching the outer back wall, and the rearward stepped portion is adapted to partially receive a rotating plate to minimize the overall depth of the microwave oven;

an air exhaust path formed between the external enclosure and the oven cavity wherein air is drawn into the suction opening passes through the air exhaust path and is exhausted through the top vent opening;

a first filter provided adjacent the suction opening; and a second filter provided adjacent the top vent opening comprising at least one filter cover including a frame supporting a filter mesh interior, wherein the at least one filter cover is removably fitted within a depressed region provided about the top vent opening area such that the filter cover is positioned below a top surface of the enclosure;

wherein the first filter is provided at the inlet of the air exhaust path and the second filter is provided at the outlet of the air exhaust path.

2. The wall mounted type microwave oven according to claim 1, further a plurality of louvers are provide across the top vent opening below the filter cover for supporting the filter cover and directing air flow.

3. The wall mounted microwave oven according to claim 1, wherein the first and second filters perform different filter functions.

4. The wall mounted microwave oven according to claim 3, wherein the second filter removes odor.

5. The wall mounted microwave oven according to claim 4, wherein the second filter is a charcoal filter.

6. The wall mounted microwave oven according to claim 3, wherein the first filter is one of a mesh or baffle filter.

7. A wall mounted type microwave oven having a front portion and a rear portion, comprising:

an external enclosure having a bottom closure wall with a front edge, a top closure wall with a front edge, and an outer back wall, where the bottom closure wall is spaced from the top closure wall to define a first height between the front edges, a suction vent opening having a first filter located adjacent the suction vent opening is provided in the bottom closure wall, and an exhaust vent opening having a second filter located adjacent the exhaust vent opening is provided in the top closure wall adjacent the front edge of the top closure wall;

an oven cavity supported within the external enclosure and having a second height, comprising an inner back wall having a rearward stepped portion extending toward and approaching the outer rear wall, and the rearward stepped portion is adapted to partially receive a rotating plate to minimize the overall depth of the microwave oven;

an exhaust air path extending between the suction vent opening and the exhaust vent opening and formed between the external enclosure and the oven cavity to define an interior exhaust air flow path that draws air from beneath the microwave oven and vents the air out the front and top of the enclosure back into a room;

a sloped portion formed in the bottom closure wall and extending downwardly and away from the front edge of the bottom wall and the oven cavity to form at least a portion of a plenum in the air path; and at least one blower provided within the plenum for drawing air into the suction vent opening and exhausting the air through the exhaust vent opening;

wherein the location of the blower in the plenum formed by a sloped portion of the bottom closure wall in combination with the location of the exhaust vent in the top closure wall provides for minimizing the first height of the external closure relative to the second height of the oven cavity while still providing for an exhaust air path that draws air from beneath the microwave oven and exhausts the air above the microwave oven into the room and the microwave oven can be mounted beneath a cabinet and a length of the top closure wall is such that the exhaust vent opening is located in front of a face of the cabinet.

8. A wall mounted microwave oven according to claim 7, wherein the exhaust vent opening is provided along a horizontal top, front surface of the microwave oven.

9. The wall mounted type microwave oven according to claim 8, further wherein the second filter comprises at least one filter cover including a frame supporting a filter mesh interior.

10. The wall mounted type microwave oven according to claim 9, further wherein the at least one filter cover is removably fitted within a depressed region provided about the exhaust vent area such that the filter cover is positioned below a top surface of the enclosure.

11. The wall mounted type microwave oven according to claim 10, further comprising a plurality of louvers are provide across the exhaust vent opening below the filter cover for supporting the filter cover and directing air flow.

12. The wall mounted type microwave oven according to claim 7, wherein the oven cavity has a front access opening and the microwave oven further comprises a pivotable door supported adjacent the front access opening, the pivotable door forming a front surface of the microwave oven and wherein the suction vent opening and the exhaust vent opening are provided on surfaces other than the front surface.

13. The wall mounted type microwave oven according to claim 7, further comprising:

a filter provided over the exhaust vent opening, the filter having a frame supporting a filter mesh interior.

14. The wall mounted type microwave oven according to claim 13, further wherein the filter is removably fitted within a depressed region provided about the exhaust vent opening area such that the filter is positioned below a top surface of the enclosure.

15. The wall mounted type microwave oven according to claim 13, and further comprising a plurality of louvers provided across the exhaust vent opening positioned below the filter for supporting the filter and directing air flow outwardly.

16. The wall mounted type microwave oven according to claim 7, wherein a plurality of louvers is provided across the exhaust vent opening for outwardly directing air flow.

* * * * *